US010041658B2

(12) United States Patent
Li et al.

(10) Patent No.: US 10,041,658 B2
(45) Date of Patent: Aug. 7, 2018

(54) ILLUMINATING DEVICE

(71) Applicant: Osram GmbH, Munich (DE)

(72) Inventors: Hao Li, Shenzhen Guangdong (CN); Xiaomian Chen, Shenzhen Guangdong (CN); Peng Chen, Shenzhen Guangdong (CN); ChengCheng Feng, Shenzhen Guangdong (CN)

(73) Assignee: LEDVANCE GmbH, Garching (DE)

( * ) Notice: Subject to any disclaimer, the term of this patent is extended or adjusted under 35 U.S.C. 154(b) by 63 days.

(21) Appl. No.: 14/408,988

(22) PCT Filed: Jun. 27, 2013

(86) PCT No.: PCT/EP2013/063564

§ 371 (c)(1),
(2) Date: Dec. 18, 2014

(87) PCT Pub. No.: WO2014/001474

PCT Pub. Date: Jan. 3, 2014

(65) Prior Publication Data

US 2015/0260379 A1 Sep. 17, 2015

(30) Foreign Application Priority Data

Jun. 27, 2012 (CN) ..... 2012 1 0218833

(51) Int. Cl.
*F21V 19/00* (2006.01)
*F21K 9/275* (2016.01)
(Continued)

(52) U.S. Cl.
CPC ..... *F21V 19/0055* (2013.01); *F21K 9/275* (2016.08); *F21V 15/015* (2013.01); *F21Y 2103/10* (2016.08); *F21Y 2115/10* (2016.08)

(58) Field of Classification Search
CPC .. F21V 19/055; F21V 19/0035; F21V 19/003; F21V 15/015; F21K 9/175; F21K 9/17; F21K 9/275
(Continued)

(56) References Cited

U.S. PATENT DOCUMENTS

2006/0203478 A1* 9/2006 Waters ..... F21L 4/00 362/217.13
2009/0224645 A1* 9/2009 Ichikawa ..... F21K 9/00 313/51
(Continued)

FOREIGN PATENT DOCUMENTS

CN 102086986 A 6/2011
CN 202266915 U 6/2012
(Continued)

OTHER PUBLICATIONS

Japanese Office Action based on Application No. 2015-517812(4 Pages and 5 pages of English translation) dated Dec. 21, 2015 (Reference Purpose Only).
(Continued)

*Primary Examiner* — William N Harris
(74) *Attorney, Agent, or Firm* — Hayes Soloway PC

(57) ABSTRACT

Various embodiments may relate to an illuminating device including a housing, an electronic assembly accommodated in the housing, and at least one adjusting mechanism arranged on at least one side of the electronic assembly, the adjusting mechanism is in operative connection with the electronic assembly and is operated from outside of the housing so that the electronic assembly is tensionedly held in the housing.

15 Claims, 1 Drawing Sheet

(51) Int. Cl.
*F21V 15/015* (2006.01)
*F21Y 103/10* (2016.01)
*F21Y 115/10* (2016.01)

(58) Field of Classification Search
USPC ..... 362/217.13; 254/98, 100
See application file for complete search history.

(56) References Cited

U.S. PATENT DOCUMENTS

2010/0181178 A1* 7/2010 Chang ..... F21V 19/008 200/341
2010/0201239 A1* 8/2010 Mostoller ..... F21K 9/175 313/1
2010/0253226 A1* 10/2010 Oki ..... F21V 3/00 315/113
2011/0117786 A1* 5/2011 Takata ..... F21K 9/17 439/628
2012/0218745 A1 8/2012 Dong et al.
2013/0077297 A1* 3/2013 Wu ..... F21K 9/17 362/218

FOREIGN PATENT DOCUMENTS

EP 2251589 A1 11/2010
EP 2395278 A2 12/2011
JP 2010165647 A 7/2010
JP 2011100653 A 5/2011
JP 2012009363 A 1/2012
WO 2011086906 A1 7/2011

OTHER PUBLICATIONS

European Office Action based on Application No. 13 736 811.4(4 Pages) dated Jan. 29, 2016 (Reference Purpose Only).
International search Report issued in PCT/EP2013/063564 dated Sep. 12, 2013.
Chinese Office Action based on Application No. 201210218833.6(7 Pages and 5 pages of English translation) dated Apr. 13, 2016 (Reference Purpose Only).

* cited by examiner

ILLUMINATING DEVICE

RELATED APPLICATIONS

The present application is a national stage entry according to 35 U.S.C. § 371 of PCT application No.: PCT/EP2013/063564 filed on Jun. 27, 2013, which claims priority from Chinese application No.: 201210218833.6 filed on Jun. 27, 2012, and is incorporated herein by reference in its entirety.

TECHNICAL FIELD

Various embodiments relate to an illuminating device.

BACKGROUND

In modern illuminating devices, higher and higher requirements for inner structure of illuminating devices are brought up, for example, an electronic assembly and a housing of the illuminating device shall be tightly connected with low cost. Particularly in a situation that a LED device, for example a LED chip is mounted in the illuminating device, the structure has to be configured reasonably to mount and/or fix a circuit board carrying the LED chip and a frame in the housing of the illuminating device. Thus, for example, in an illuminating device having a tube-shaped contour, a T8/T5 tube for instance, a circuit board shall be fixed inside the lamp body by means of auxiliary materials along an extending direction of the circuit board.

In the related art, a metal frame carrying the circuit board is generally stuck on the inner surface of the tube by means of glue to realize a fixed connection. Such a fixing structure renders that the illuminating device can only have one side for light output, wherein the illumination zone fails to cover the paste area. Moreover, as the metal frame carrying the circuit board and the glue for fixing have a relative big deadweight, the weight of the illuminating device per se is on one hand relative big, and the cost of the illuminating device is on the other hand relative high. Furthermore, it is hard to fix the circuit board in an illuminating device having a relative big size, partitularly length using such fixing method.

In order to avoid the above mentioned problems, there is need to improve illuminating devices having a relative big size, a tube-shaped illuminating device for instance, so that the circuit board carrying a light source, for example a LED chip can be directly firmly mounted inside the housing of the illuminating device, without auxiliary materials for fixing, such as glue etc.

SUMMARY

Therefore, various embodiments provide an illuminating device, which is simply manufactured, and has low cost and a small deadweight. Moreover, assemblies inside the illuminating device can be firmly held in the housing without adhesive, which provides possibilities for light output in multi- or omni-directions.

An illuminating device according to various embodiments has a housing and an electronic assembly accommodated in the housing, characterized by further including at least one adjusting mechanism arranged on at least one side of the electronic assembly, the adjusting mechanism is in operative connection with the electronic assembly and can be operated from outside of the housing so that the electronic assembly is tensionedly held in the housing. According to various embodiments, users are capable of directly operating the adjusting mechanism from external, and applying an acting force to the electronic assembly from one side of the housing, so as to tension the side of the electronic assembly facing the adjusting mechanism. Thus, there is no need to contact the electronic assembly with circumferential wall of the housing and fix the same thereon. Instead of that, the electronic assembly is held between both ends of the housing only in a "tensioned" state. The electronic assembly fixed in the housing in such a manner is capable of providing an illumination zone of 360° in a circumferential direction, which avoids the defects in the related art that a omni-illumination cannot be realized based on the reasons of installation position of the electronic assembly.

According to various embodiments, the adjusting mechanism can be operated so that the electronic assembly can be exerted a force towards the end of the housing. Users can change the acting force applied to the electronic assembly using the adjusting mechanism, and then changes the distance between an end of the electronic assembly and a corresponding end of the housing in an axial direction, viz. in an extending direction of the housing, so that the electronic assembly is tensioned between both ends.

According to various embodiments, the adjusting mechanism includes a connector located in the housing and a thread regulating member partly extending into the housing from external, a first end of the connector is fixed connection with an end of the electronic assembly and a second end of the connector is threaded with the thread regulating member. The adjusting mechanism connects on one hand the housing with the electronic assembly, and on the other hand, is capable of changing the distance between the electronic assembly and the end, at which the adjusting mechanism is arranged, by means of the thread regulating member.

According to various embodiments, a stop slot for accommodating the end is opened in the first end. The end of the electronic assembly can be inserted into said stop slot, and the two are position-fixedly connected by means of additional fixing parts and connectors. Thus, it can be prevented that the location of the electronic assembly displaces with respect to connectors, during the adjusting process, so that a tensioning force towards the end of the housing is applied to the electronic assembly in an axial direction.

According to various embodiments, a regulating part is arranged at the second end for screwing the thread regulating member in and/or out. Said thread regulating member is for example screw or the like.

According to various embodiments, the regulating part includes an elongated hole and a nut embedded into the elongated hole, and the thread regulating member moved in the elongated hole by means of screw-connection with the nut. In this case, the connector is made from plastic material for instance, and a metallic nut can be arranged in the connector by insert-injection process, so as to form a thread connection with the thread regulating member.

According to various embodiments, the regulating part is an elongated threaded hole. In this case, the regulating part extends towards the electronic assembly from one side of the end surface, wherein thread structure is formed on the inner surface thereof.

According to various embodiments, the housing has two axial end surfaces, a through hole for penetration of the thread regulating member being opened on at least one of the end surfaces . By means of the thread regulating member penetrating the through hole, an acting force can be applied to the electronic assembly in an axial direction from outside of the housing.

According to various embodiments, the thread regulating member has a screw rod with external thread and a stop end formed at one end of the screw rod. When screwing the stop end, the thread regulating member can axially move in the regulating part by means of matching the external thread of the screw rod with the thread structure in the regulating part.

According to various embodiments, a circumferential edge of the through hole is concave with respect to the end surface to form a stop region. Through screwing the thread regulating member in a direction facing to the electronic assembly, the stop end thereof can press against the stop region, and press said end surface towards the electronic assembly, so as to interact with the oppositely arranged end surfaces of the housing to tensionedly hold the electronic assembly between the two ends of the housing.

According to various embodiments, the housing has a tubular body and at least one end cap, on which the end surface is formed. The adjusting mechanism for changing the state of the electronic assembly in the housing operates on said end cap, particularly on the end surface. Thus, an acting force can be applied to the electronic assembly from one or both ends of the housing.

According to various embodiments, the tubular body has an open end closed by the end cap and a closed end, the two end surfaces are respectively formed on the end cap and the closed end, the adjusting mechanism is operable from one side of the end cap, so that the electronic assembly is tensionedly held in the housing. If one end of the tubular body has a closed end surface formed with the body in one piece, only one end cap is needed to close the open end of the body, wherein the closed end surface is in connection with one end of the electronic assembly, while the end cap is in connection with the other end of the electronic assembly. When adjusting the fixed state of the electronic assembly, it only needs to change the distance between the end cap and the electronic assembly by means of the adjusting mechanism, so as to increase or decrease the tensioning force bore by the electronic assembly in the housing.

According to various embodiments, the tubular body has open ends being closed by means of two end caps, the two end surfaces are respectively formed on the end caps, and two adjusting mechanisms are operable respectively from one side of the end caps, so that the electronic assembly is tensionedly held in the housing. If the tubular body is configured as having two open ends, the electronic assembly can be tensioned by using end caps respectively from two oppositely arranged sides. And then, the tensioning force applied to the electronic assembly can be adjusted by the thread regulating member, so as to change the state of the electronic assembly in the housing.

According to various embodiments, the illuminating device is configured as tube-shaped, and the electronic assembly includes a circuit board in stripe-shape and a light source mounted on the circuit board. Said illuminating device is configured as for example T5/T8 illuminating device, and the light source mounted therein is preferably a linear light source.

According to various embodiments, the light source is a LED chip. Thus, an illuminating device having a LED chip mounted has advantages of high efficiency and energy saving.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the following detailed description, reference is made to the accompanying drawings, which form a part hereof, and in which is shown by way of illustration specific embodiments in which the disclosure may be practiced. In this regard, directional terminology, such as "top", "bottom", "inner", "outer", is used in reference to the orientation of the figures being described. Because components of embodiments of the present disclosure can be positioned in a number of different orientations, the directional terminology is used for purposes of illustration and is in no way limiting. It is to be understood that other embodiments may be utilized and structural or logical changes may made without departing from the scope of the present disclosure. The following detailed description, therefore, is not to be taken in a limiting sense, and the scope of the present disclosure is defined by the appended claims.

It is to be understood that the features of the various exemplary embodiments described herein may be combined with each other, unless specifically noted otherwise.

Figure 1:
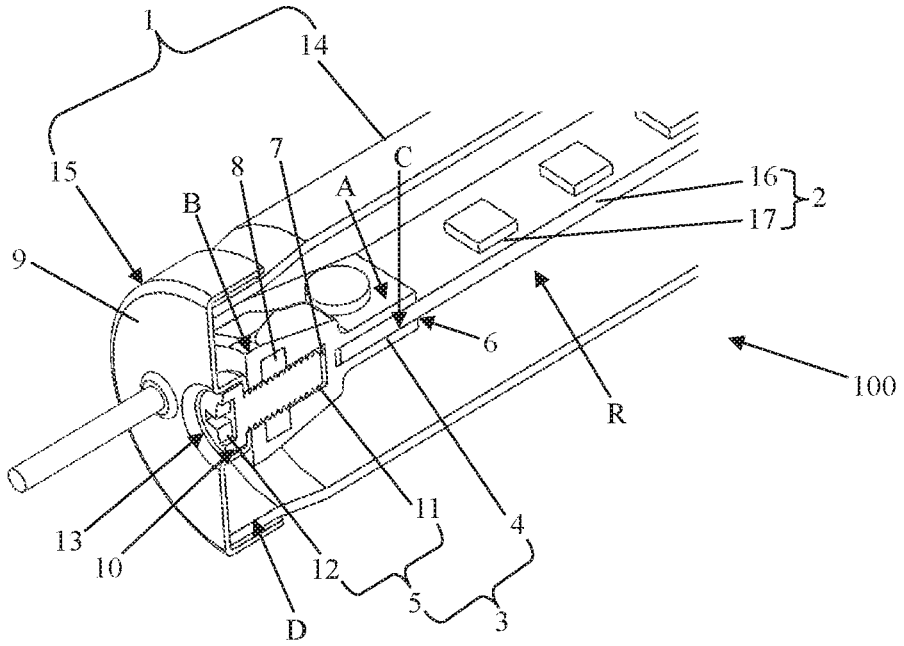
FIG. 1 is a partial 3D enlarged figure of the first example of the illuminating device according to the present disclosure.

A partial 3D enlarged figure of the first example of the illuminating device according to the present disclosure is shown in FIG. 1. In said example, the illuminating device 100 is configured as T5/T8 illuminating device having a tube-shaped contour. The illuminating device 100 includes a housing 1 configured as a tube, and an elongated electronic assembly 2 accommodated in the housing 1, wherein said electronic assembly 2 in the present example includes a circuit board 16 in stripe-shape and a linear light source 17 mounted on the circuit board 16. For the reason of being concise, only an amplifier figure of an end segment of the illuminating device 100 is shown here.

In order to fix the electronic assembly 2 in the housing without effecting the illumination, an additional adjusting mechanism 3 is preferably arranged in the illuminating device 100. Thus, at least one end of the housing 1 is in connection with an end C of the electronic assembly 2, viz. the circuit board 16 with an adjustable manner, so that the electronic assembly 2 is axially fixed in the housing 1 without contacting with the circumferential wall of the housing 1, and an all omni-directional light output can then be realized.

The housing 1 includes a tubular body 14 and an end cap 15 for closing at least one open end D thereof in a covering manner, wherein the other end of the housing 1 not shown in the figure can be either a closed end surface E formed with the tubular body 14 in one piece, or an open end E' also being closed by the another end cap 15. One end C of the elongated circuit board 16 can be in operative connection with an end surface 9 of the end cap 15 by means of an adjusting mechanism 3, and the end surface 9 can approach the end C by operating the adjusting mechanism 3 from one side of the end surface 9 departing from the electronic assembly 2. The other unshown end of the circuit board 16 is in connection with a closed end surface (also unshown here) or another corresponding end cap. When at least one end surface 9 approaches the electronic assembly 2 in an axial direction under the effect of the adjusting mechanism 3, the distance between both ends of the housing 1 decreases, and the circuit board 16 can therefore be clamped between both ends. In this case, an axial pulling force is applied to the circuit board 16 at one side in connection with the adjusting mechanism 3, so that the circuit board 16 is fixed in an inner cavity R defined in the housing 1 in a tensioned manner.

Figure 2:
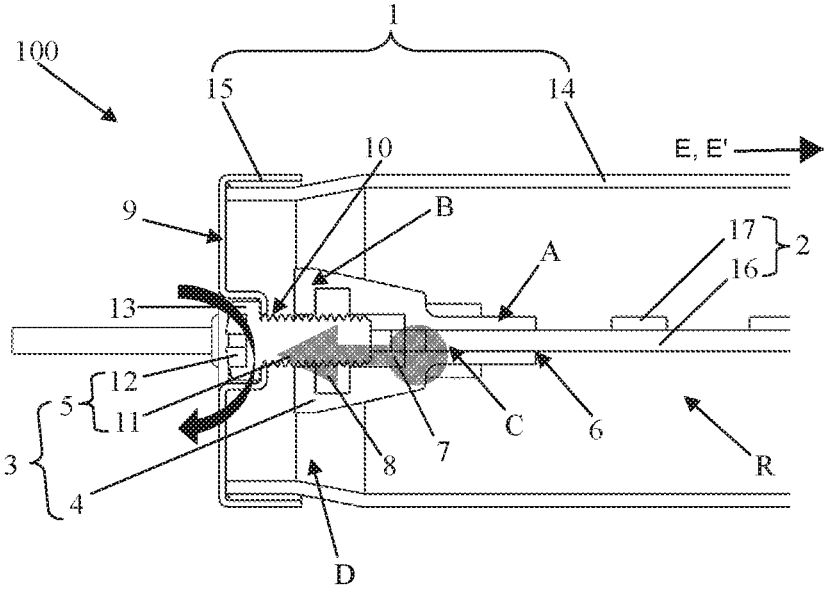
FIG. 2 is a partial profile enlarged figure of the first example of the illuminating device according to the present disclosure.

In combination with the profile figure shown in FIG. 2, it can be clearly seen that the adjusting mechanism 3 includes a connector 4 located in the cavity R and a thread regulating member 5 stretching from outside of the housing 1 through the end surface 9 into the cavity R. For this purpose, a through hole 10 for penetration of the thread regulating member 5 is particularly opened on the end surface 9. A first end A of the connector 4 is in fixed connection with the end C of the circuit board 16, so as to assure that the fixed connection between the connector 4 and the circuit board 16 can be maintained when operating the adjusting mechanism to transfer an acting force to the circuit board 16. As shown in FIGS. 1 and 2, the first end A holds the end C therein by means of a stop slot 6 opened therein, and the first end A and the end C can be fixed together in a direction extending to the stop slot 6 by an additional fixing part. A second end B of the connector 4 is used to connect with the thread regulating member 5 in a matched manner. In the present example, an elongated hole 7 for axial movement of the thread regulating member 5 is opened in the second end B of the connector 4, which is made from plastic material for instance, wherein the inner surface thereof is a smooth surface. A metallic nut 8 for thread connection with the thread regulating member 5 is coaxially integrated with the elongated hole 7 as one piece by insert-injection process or the like.

The thread regulating member 5 configured as bolt includes a screw rod 11 and a stop end 12 having an end surface with grooves. The screw rod 11 extends into the nut 8 from the second end B of the connector 4 and forms thread connection, wherein the length of the screw rod 11 extending into the elongated hole 7 is regulated by screwing the stop end 12 from outside of the housing 1. When screwing the thread regulating member 5 into the connector 4 by means of the grooves on the stop end 12, the stop end 12 presses against a circumferential edge of the through hole 10, and said region is concave with respect to the end surface 9 to form a stop region 13 for the stop end 12. The closer the end of the screw rod 11 is away from the circuit board 16, the bigger the axial pressure is, which is applied by the stop end 12 in the stop region 13. Thus, a pulling force towards the end surface 9 can be applied to the circuit board 16 from outside of the housing 1 to tensionedly hold the circuit board 16 in the inner cavity R. In this case, the other unshown end of the circuit board 16 can be fixed on the other end of the housing 1, which is also not shown here. Therefore, the circuit board 16 can be tensionedly held between two ends of the housing 1 without contacting the perisporium of the housing 1.

The arrow in FIG. 2 shows the screwing direction of the thread regulating member 5 and the moving direction of the connector, if the circuit board 16 gets loose from the two ends of the housing 1. If the adjusting mechanism 3 is operated from external, the end C of the circuit board 16 is applied with a pulling force towards the end surface 9, so that the circuit board 16 is in a tensioned state.

In an unshown example, the regulating part in the second end B for realizing thread connection with the thread regulating member 5 is an elongated threaded hole. The screw rod 11 can be screwed in or out of the elongated threaded hole, directly using the thread structure on the outer circumferential wall per se.

If both ends of the tubular body 14 are open ends D, the open ends D can be closed respectively by means of the end caps 15 as shown in FIGS. 1 and 2. In such a manner, the adjusting mechanism 3 is operable simultaneously from both ends in an axial direction, so that the circuit board 16 is tensionedly held between both end caps 15, as the described operation process.

If the tubular body 14 has a closed end and an open end, it only needs to operate the adjusting mechanism 3 from the end having an end cap 15. One end of the circuit board 16 is in connection with the closed end, while the other end bears a pulling force applied by the adjusting mechanism 3, so that the circuit board 16 is tensionedly held between the end cap and the closed end of the tubular body 14.

In the examples mentioned above, the light source 17 mounted on the circuit board can be either a LED chip, or a light source of another type.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. An illuminating device comprising:

a housing, an electronic assembly accommodated in the housing, and at least one adjusting mechanism arranged on at least one side of the electronic assembly, wherein the adjusting mechanism is in operative connection with the electronic assembly and is operated from outside of the housing so that the electronic assembly is tensionedly held in the housing; wherein the electronic assembly does not contact a circumferential wall of the housing;

wherein the adjusting mechanism comprises a connector located in the housing and a thread regulating member partly extending into the housing, a first end of the connector is fixed with an end of the electronic assembly and a second end of the connector is threaded with the thread regulating member;

wherein a stop slot for accommodating the end of the electronic assembly is opened in the first end and wherein the end of the electronic assembly is held in the stop slot.

2. The illuminating device according to claim 1, wherein the adjusting mechanism is operated so that the electronic assembly is exerted a force towards an end of the housing.

3. The illuminating device according to claim 1, wherein the connector comprises a regulating part located at the second end for screwing the thread regulating member in or out.

4. The illuminating device according to claim 3, wherein the regulating part comprises an elongated hole and a nut embedded into the elongated hole, and the thread regulating member is moved in the elongated hole by means of a screw-connection with the nut.

5. The illuminating device according to claim 3, wherein the regulating part is an elongated threaded hole.

6. The illuminating device according to claim 1, wherein the housing has two axial end surfaces, a through hole for penetration of the thread regulating member being opened on at least one of the end surfaces.

7. The illuminating device according to claim 6, wherein the thread regulating member has a screw rod with external thread and a stop end formed at one end of the screw rod.

8. The illuminating device according to claim 6, wherein a circumferential edge of the through hole is concave with respect to the at least one end surface of the housing to form a stop region.

9. The illuminating device according to claim 8, wherein the housing has a tubular body and at least one end cap, on which the end surface is formed.

10. The illuminating device according to claim 9, wherein the tubular body has an open end closed by the end cap and a closed end, the two axial end surfaces are respectively formed on the end cap and the closed end, the adjusting mechanism is operable from one side of the end cap, so that the electronic assembly is tensionedly held in the housing.

11. The illuminating device according to claim 9, wherein the tubular body has open ends closed by two end caps, the two end surfaces are respectively formed on the end caps, and two adjusting mechanisms are operable respectively from one side of the end caps, so that the electronic assembly is tensionedly held in the housing.

12. The illuminating device according to claim 1, wherein the illuminating device is configured as tube-shaped, and the electronic assembly comprises a circuit board having a strip shape and a light source mounted on the circuit board.

13. The illuminating device according to claim 12, wherein the light source is a LED chip.

14. An illuminating device comprising:

a housing, an electronic assembly accommodated in the housing, and at least one adjusting mechanism arranged on at least one side of the electronic assembly, wherein the at least one adjusting mechanism is in operative connection with the electronic assembly and is operated from outside of the housing so that the electronic assembly is tensionedly held in the housing; wherein the at least one adjusting mechanism is disposed in the same plane as the electronic assembly; and wherein the electronic assembly does not contact a circumferential wall of the housing.

15. An illuminating device comprising:

a housing, an electronic assembly accommodated in the housing, and at least one adjusting mechanism arranged on at least one side of the electronic assembly, wherein the adjusting mechanism is in operative connection with the electronic assembly and is operated from outside of the housing so that the electronic assembly is tensionedly held in the housing;

wherein the electronic assembly does not contact a circumferential wall of the housing;

wherein the adjusting mechanism comprises a connector located in the housing and a thread regulating member partly extending into the housing, a first end of the connector is fixed with an end of the electronic assembly and a second end of the connector is threaded with the thread regulating member;

wherein a stop slot for accommodating the end of the electronic assembly is opened in the first end and wherein the end of the electronic assembly is held in the stop slot; wherein the stop slot and the adjusting mechanism are disposed in the same plane.

* * * * *